United States Patent [19]

Holmes

[11] 4,209,195

[45] Jun. 24, 1980

[54] EXPANDABLE SPREADER CONTROL CIRCUIT

[75] Inventor: William K. Holmes, Rothschild, Wis.

[73] Assignee: J. I. Case Company, Racine, Wis.

[21] Appl. No.: 947,548

[22] Filed: Oct. 2, 1978

[51] Int. Cl.[2] ..... B66C 1/00

[52] U.S. Cl. ..... 294/81 SF

[58] Field of Search ..... 294/81 SF, 67 DA, 67 D, 294/67 R, 81 R, 88, 110; 414/620, 621, 730

[56] References Cited

U.S. PATENT DOCUMENTS

| | | | |
|---|---|---|---|
| 3,833,140 | 9/1974 | Young et al. | 294/81 SF |
| 3,858,728 | 1/1975 | Fathauer | 294/81 SF |

*Primary Examiner*—James B. Marbert

*Attorney, Agent, or Firm*—Dressler, Goldsmith, Shore, Sutker & Milnamow, Ltd.

[57] ABSTRACT

A control system for extending and retracting a spreader having a base section and a pair of extensible sections includes a hydraulic circuit for supplying pressurized fluid to fluid rams to extend and retract the sections with an electric control circuit for actuating a control valve. The electric control circuit includes a manual switch having extend and retract positions energizing extend and retract solenoids on the valve. The electric circuit also includes holding means for maintaining either solenoid energized and position control means for automatically deenergizing either solenoid when the sections reach a predetermined position with respect to each other. A single two-position switch is utilized as the position control means cooperates with the hydraulic circuit which locks the spreader sections in predetermined position with respect to each other. These predetermined positions are defined by an elongated rod having detents spaced thereon and secured to one extensible section with an electrical cable surrounding the rod and extending to the outer end of the extensible section to define the electrical connections between the switches on the extensible sections and the remainder of the electrical circuit and the hydraulic circuit on the base section.

19 Claims, 7 Drawing Figures

P
74
82
70
72
102
102
103
76
104
36
36
105
106
107
107
108
40
42
46
80
78
83
83
46
42
40
84
86
90
92
96
95
99
93
98
94
97
100
101

EXPANDABLE SPREADER CONTROL CIRCUIT

Background of the Invention

The present invention relates generally to spreaders or lifting beams and more particularly to an expandable spreader capable of being utilized for lifting containers of different sizes.

In recent years, considerable emphasis has been directed towards development of units that can be utilized for moving containerized cargo in dock and railroad areas. The most common type of unit that has been utilized for this purpose consists of some type of U-shaped frame which defines an open cargo container bay and the unit is usually self-propelled so that it can be manipulated to place a container in the bay area. This type of unit or straddle carrier conventionally has a spreader located within the bay area which can be raised and lowered and the container has corner fittings or castings having apertures of standard design with the spreader having latching mechanisms at the four corners thereof which are received into the apertures in the castings and secured therein so that the containers can be lifted and transported.

In the past few years, the sizes of containers have become fairly standard. Usually, the containers are 8 feet high and 8 feet wide and the most common lengths have been 20 or 40 feet. However, there are some containers of intermediate lengths, such as 30 or 35 feet and a few containers of various other intermediate lengths.

In order to accommodate various sizes of containers, numerous expandable spreaders have been proposed. One type of expandable spreader that has been proposed consists of a base section and expandable sections with latching mechanisms supported on the expandable sections. In order to increase the versatility of such a unit, it is desirable to have the spreader capable of being designed to accommodate various sizes of containers. In the past, this has been accomplished with rather complicated mechanisms such as motors with synchronized drive mechanisms for the respective sections. The motors are started and stopped through complicated switching systems. Another proposed solution is to use plural cylinder and piston rod assemblies as the extension and retraction mechanism.

Summary of the Invention

The control system of the present invention is capable of accurately positioning extensible sections of a spreader frame to any number of a plurality of predetermined positions and holding the sections in such predetermined positions without any additional latching mechanisms normally utilized for expandable spreaders of this type. While not limited to any particular type of expandable spreader, the control system is specifically designed for the synchronized expandable spreader disclosed in U.S. Ser. No. 947,551.

More specifically, the control system incorporates a hydraulic circuit that includes solenoid operated valve means for controlling supply of hydraulic fluid to fluid rams that are utilized for extending and retracting the telescoping spreader sections. The solenoid operated valve means is controlled through an electric control circuit which includes a manually operated selector means for selectively energizing one of the two solenoids on the valve means and position control means for automatically deenergizing the solenoid when the extensible sections reach a predetermined position with respect to each other. Whenever the sections reached a predetermined expanded or contracted position and the energized solenoid becomes deenergized, the hydraulic control circuit locks the spreader sections in such position through pressure responsive lock check valves and a synchronous cable device.

The electric control circuit also incorporates a holding means for maintaining either solenoid energized after initial energization by the manually operated selector means and the holding means is designed to preclude simultaneous energization of both solenoids. In the specific embodiment of the electric control circuit, switches are incorporated therein for indicating when the latch mechanisms of the spreader are in either latched or unlatched positions and the switches are located in series with the manually operated selector means to prevent energization of either solenoid when the latching mechanisms are in the latched position.

The position control means is in the form of a two-position switch which is moved between positions by an actuator that is in the form of an elongated rod that has a plurality of axially spaced detents which define the respective positions for the spreader sections. The rod has a plurality of sets of circumferentially spaced detents so that repositioning of the rod circumferentially with respect to the position control switch will adapt the spreader to be positioned for different sizes of containers and may be easily varied in spacing.

The actuating member or control rod is also utilized as the support for electric cables that must extend from one section to the other and in the specific embodiment, the electric cable is helically coiled around the control rod so that it is capable of expanding and contracting in response to movement of the sections with respect to each other.

Detailed Description

Figure 1:
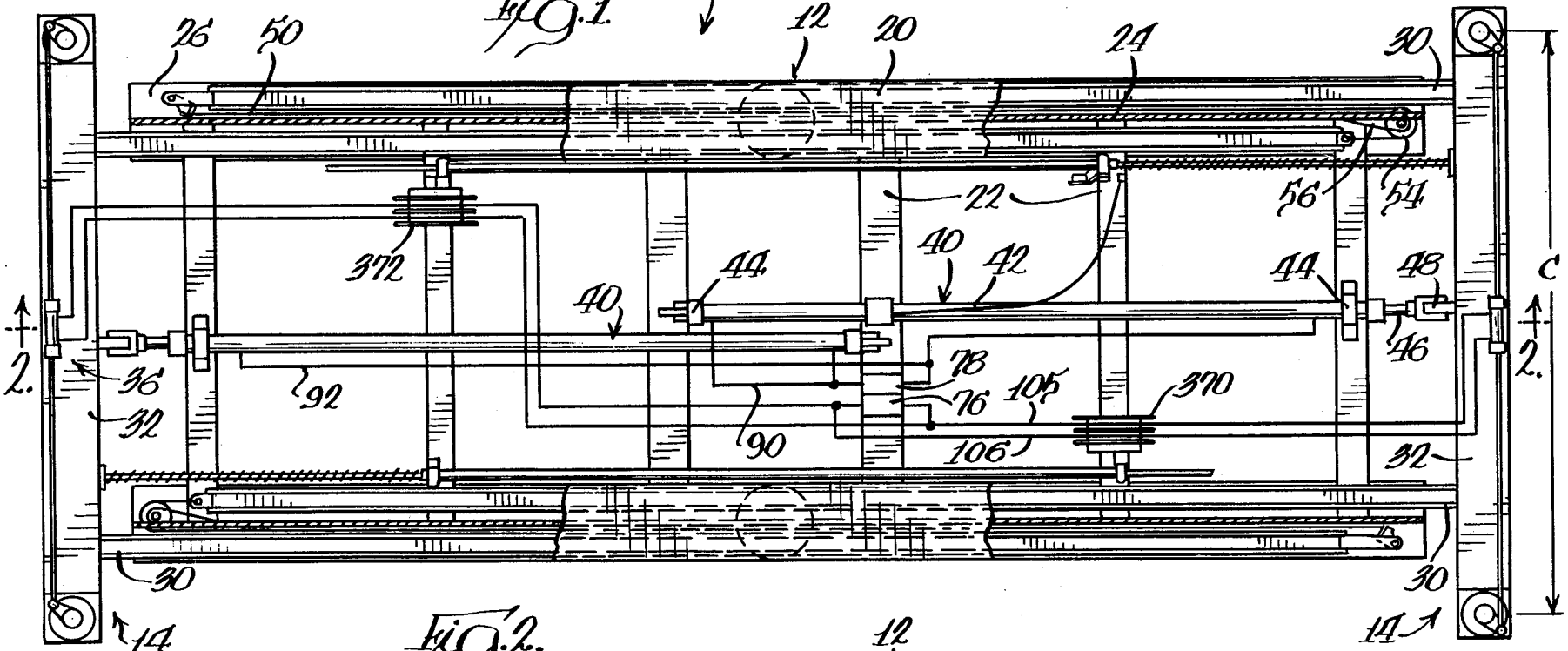
FIG. 1 is a plan view, partly in section, showing an expandable spreader having the present invention incorporated therein.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

Figure 2:
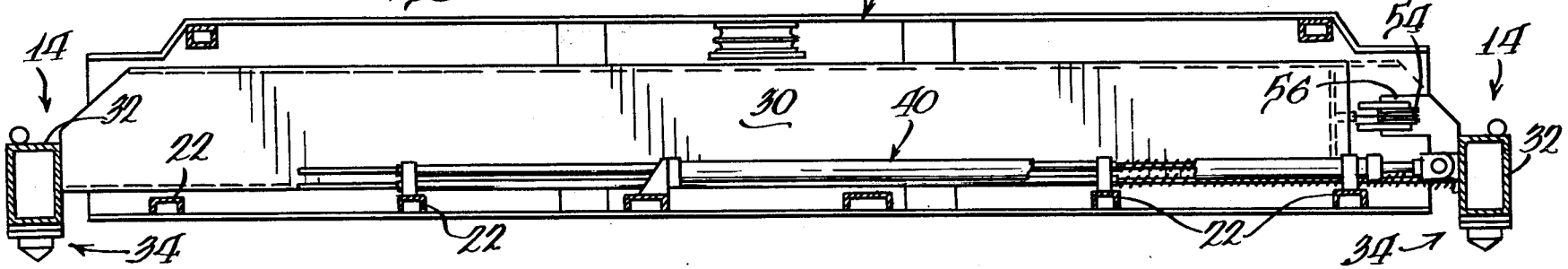
FIG. 2 is a sectional view as viewed along line 2—2 of FIG. 1.

FIGS. 1 and 2 of the drawings disclose a spreader assembly generally designated by reference numeral 10 which is preferably of the type that can be used with a self-propelled vehicle of the type disclosed in U.S. Ser.

No. 844,655, filed Oct. 25, 1977 and assigned to the assignee of the present invention. Spreader 10 includes a base section 12 and first and second extensible and retractable sections or members 14 extending from opposite ends of section 12. Base section 12 consists of first and second transversely spaced parallel beams 20 which are interconnected by a plurality of cross members 22 to define a substantially rectangular frame. In the preferred embodiment, beam 20 is in the form of an I-beam having a central vertical web portion 24 and a pair of upper and lower horizontal legs 26.

Each extensible section 14 is identical in cross section and only one will be described in detail. Extensible section or member 14 includes first and second transversely spaced parallel legs 30 which are interconnected at their outer ends by a transverse member 32 that may be secured thereto by welding. Legs 30 extend parallel to each other and are spaced from each other by a dimension which is equal to the spacing between the webs 24 of the respective beams 20. Legs 30 may be hollow rectangular beams or any other configuration having sufficient strength to support the weight of the container that is to be lifted.

Transverse beams 32 may also be hollow rectangular members each having a latching mechanism 34 at each end thereof. Latching mechanisms 34 are moved between the latched and unlatched position through fluid ram means 36 which will be described in more detail later. Latching mechanisms 34 may be any standard type but are preferably of the type disclosed and claimed in copending application Ser. No. 947,550, incorporated herein by reference.

Extensible members 14 are moved relative to base section 12 through independent drive means 40. In the illustrated embodiment, each drive means is in the form of a cylinder and piston rod assembly with a cylinder 42 supported on cross members 22 and secured thereto by suitable brackets 44. Piston rod 46 of fluid ram 40 is connected to cross member 32 through a suitable bracket 48.

Spreader 10 also incorporates synchronizing means between the base section and each of the extensible members to produce equal increments of movement of both of the extensible members in response to actuation of fluid rams 40. The synchronizing means consists of first and second cables 50 of equal length having opposite ends respectively secured to the respective extensible members 14 and an intermediate portion guided on a pulley 54 that is supported by a bracket 56 on an end of an I-beam 20.

The manner in which the synchronizing mechanism operates is disclosed in U.S. Ser. No. 947,551 which is incorporated herein by reference.

As indicated above, one of the problems encountered with expansible spreaders is accurate positioning of the latching mechanisms 34 in each of the various positions required to accommodate containers of varying lengths. Heretofore, this has normally been accomplished by either manually extending respective expandable sections to coincide with container lengths and then positioning latching pins to lock the expansible sections to the base section. Other means of accomplishing the accurate positioning of the telescoping extensible sections include complicated drive motors having synchronized driving gears for accurately positioning the spreader sections with respect to each other. However, these types of mechanisms have a serious drawback in that they are extremely expensive and the various components thereof have a tendency to wear which results in inaccurate positioning of the latching mechanisms.

Further types of mechanisms for positioning the latching mechanisms at various extended positions on a base frame includes plural hydraulic fluid rams, each set of which is actuated to extend the various sections a predetermined amount with respect to each other. Again, this arrangement requires complicated hydraulic circuitry and numerous valves as well as additional separate components for operating each of the valves for producing a given predetermined length for the spreader. The number of positions in this type of expandable spreader is limited by the number of cylinders incorporated into the system.

According to the present invention, a unique electric and hyraulic control system has been developed for accurately positioning a plurality of spreader sections with respect to each other to accommodate containers of various lengths. The unique hydraulic and electric control system is capable of being converted to accommodate various containers of numerous intermediate lengths with only minimal modification thereof. Furthermore, the mechanism is designed such that it eliminates the need for any mechanical interlocks, such as pins or latching mechanisms for interlocking the various sections with respect to each other when a predetermined position has been reached.

Figure 6:
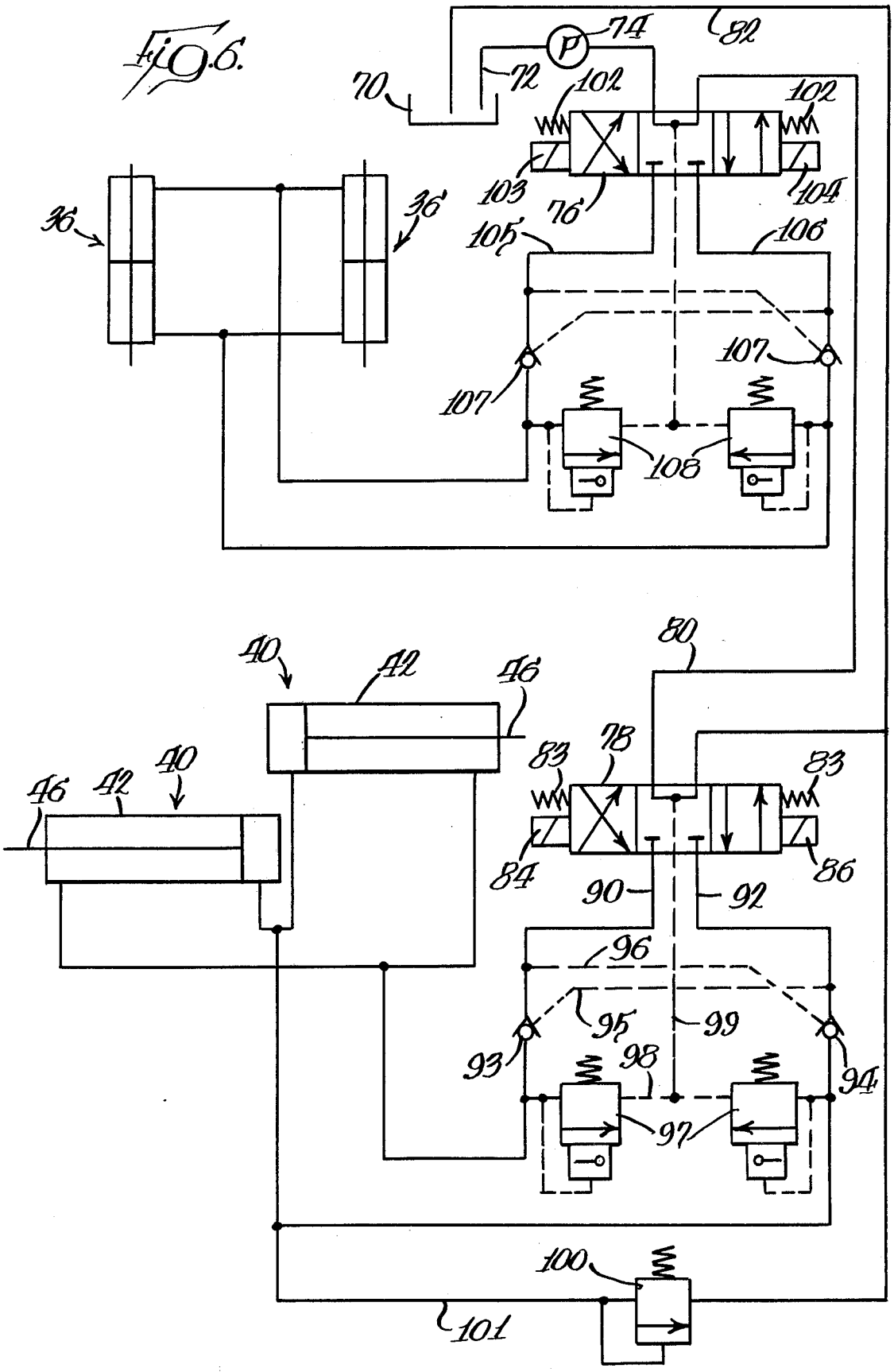
FIG. 6 is a schematic illustration of the hydraulic circuit that forms part of the control circuit.

FIG. 6 of the drawings discloses the hydraulic circuit of the present invention for supplying pressurized hydraulic fluid to fluid rams 36 and 40 for both latching and unlatching the latching mechanisms 34 and for extending and retracting the respective sections relative to each other. The hydraulic circuit includes a reservoir 70 with a conduit 72 leading from reservoir 70 to a pump 74 which produces a pressurized hydraulic source. Pressurized hydraulic source 74 is connected to a first valve 76 and the first valve is connected to a second valve 78 through a conduit 80. Reservoir 70 is also connected in series with valves 76 and 78 through a conduit 82. Thus, pressurized fluid from pump 74 is delivered to valve 76 and, if valve 76 is in a closed condition illustrated in FIG. 6, the pressurized fluid is delivered from valve 76 to valve 78. If both valves are in the closed condition illustrated in FIG. 6, the pressurized fluid will be returned directly to the reservoir.

Considering first the portion of the hydraulic circuit for supplying pressurized fluid to extension and retraction fluid rams 40, valve 78 is in the form of a three-position, solenoid operated valve having a valve spool normally biased to the centered position illustrated in FIG. 6 through springs 83. Solenoid operated valve means 78 has a first solenoid 84 at one end thereof and a second solenoid 86 at the opposite end thereof which are energized through an electric circuit that will be described later. Solenoid valve means 78 is connected to opposite ends of both fluid rams 40 through first and second conduits 90 and 92 so that pressurized fluid received in either conduit 90 or 92 will be simultaneously supplied to the same end of both fluid rams 40.

According to one aspect of the invention, the conduit means 90 and 92 between solenoid operated valve means 78 and fluid rams 40 incorporate hydraulic lock means for trapping the fluid in both ends of the fluid rams 40 when valve 78 is in the neutral position. The lock means illustrated consists of first and second self-locking check valves 93 and 94 respectively located in conduits 90 and 92 and valve 93 is opened in response to pressurized fluid being delivered from conduit 92 through a branch conduit 95. Likewise, hydraulically locked check valve 94 is pressure responsive to the pressure in conduit 90 through branch conduit 96. Thus, when valve 78 moves to a neutral condition, self-locking valves 93 and 94 are closed to trap the fluid in both ends of the cylinders 42 of fluid rams 40 and, in conjunction with cables 50, lock the spreader sections in a predetermined position.

The portion of the hydraulic circuit for supplying fluid to rams 40 also includes first and second thermal relief valves 97 that are located in a conduit 98 interconnecting conduits 90 and 92 with conduit 98 also being connected through a further conduit 99 to return conduit 82. Thus, if there is excessive pressure developed by heat, valves 97 will open to relieve such excessive pressure.

The portion of the circuit for supplying fluid to hydraulic rams 40 also includes a main relief valve 100 in a conduit 101 located between conduits 92 and 82. This relief valve is set at a fairly high pressure and is designed to open and relieve the pressure in conduit 92 when the pressure of the hydraulic fluid reaches a certain level to prevent rod distortion of the piston rods 46.

The hydraulic circuit for supplying fluid to latching and unlatching fluid rams 36 is substantially identical to that described in connection with a portion of the circuit for fluid rams 40. Again, valve 76 is a solenoid operated three-position valve that is normally biased to a centered closed position through springs 102. The valve is moved to the two operated positions through solenoids 103 and 104 and is connected to the opposite ends of both fluid rams through conduits 105 and 106. Conduits 105 and 106 again have pressure responsive relief valves 107 and thermal relief valves 108 and valves 107 operate to trap the fluid in both ends of fluid rams 36 when valve 76 is in a neutral condition.

Figure 3:
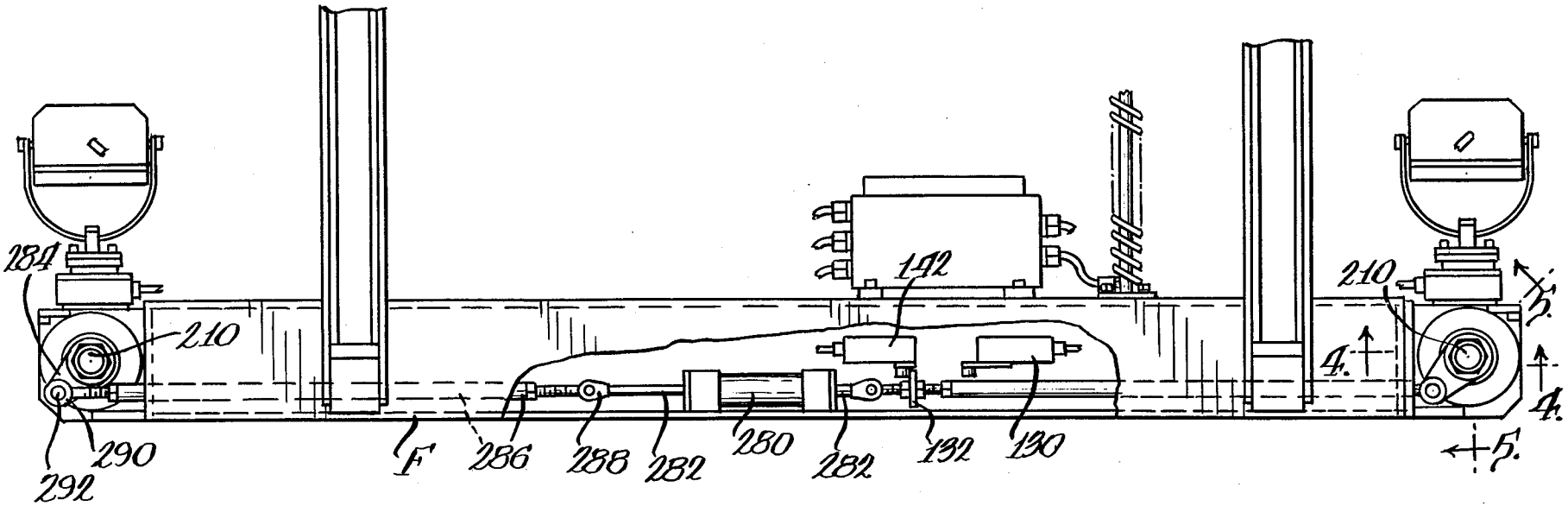
FIG. 3 is an enlarged fragmentary view of one of the expandable spreader sections with parts thereof broken away for clarity.

To complete the description of the latching mechanisms reference is made to FIG. 3 which shows details of the fluid rams 36 and connection components. The rotating means for rotating latching mechanisms 34 includes a single cylinder 280 which is supported on the center of transverse beam 32 and has a single piston (not shown) slidably supported therein. The single piston has two piston rods 282 extending from opposite sides thereof and each rod is connected to the free end of an arm 284 supported on the upper end of a shank 210 of latching mechanisms 34. The connection between arm 284 and piston rod 282 includes an adjustable connecting rod 286 which has one end connected through a clevis 288 to the free end of piston rod 282 and the opposite end connected to arm 284 through an eyelet bracket 290 and a bolt 292.

Utilizing a single cylinder equally spaced from two latching mechanisms and two piston rods reduces the span or distance that must be traversed by the connecting rod which reduces the amount of distortion that might be encountered by the connecting rod during normal operation of the latching mechanisms.

Figure 7:
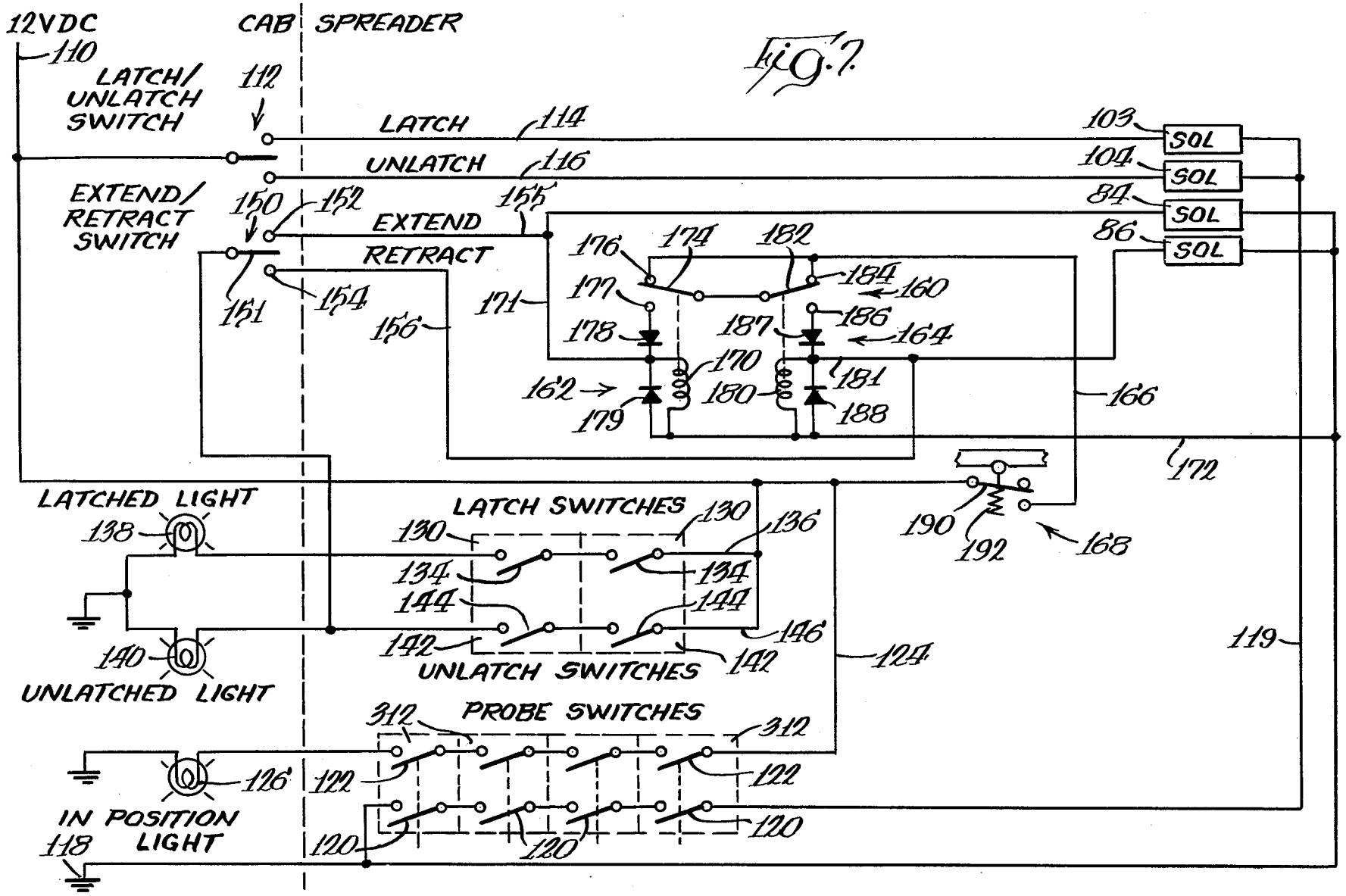
FIG. 7 is a schematic illustration of the electric portion of the control circuit.

The electric control circuit for controlling energization of the solenoids associated with valves 76 and 78 is illustrated in FIG. 7 and includes a power source, such as a 12 volt DC source, connected to line 110. Main line 110 is connected to latch and unlatch solenoids 103 and 104 through a manually operated switch 112 and lines 114 and 116. Manually operated switch or selector means 112 is preferably a three-position switch which is biased to the neutral position illustrated in FIG. 7 and is movable to energize either line 114 or 116 and thereby energize solenoids 103 or 104. Preferably, solenoids 103 and 104 are connected to ground 118 through a line 119 that has a first set of contacts 120 of four identical probe switches 312. The respective probe switches are associated with each of the four corner latching mechanisms 34 and the operation thereof is described in more detail in my copending application Ser. No. 947,550, filed Oct. 2, 1978.

Each of the switches 312 has a second contact 122 and contacts 122 are connected in series between line 124 leading from main power source 110 to an "in position" light 126 which gives an indication to the operator when all of the latching mechanisms are in a proper position to be operated to latch the spreader to the container.

The latching and unlatching circuit also incorporates first and second indicator means to indicate the position of the latching mechanism within the cab for the vehicle. A pair of latching switches 130 are respectively located on transverse beams 32 at opposite ends of the spreader frame and are actuated through a suitable actuating mechanism 132 (FIG. 3) forming part of the latching and unlatching mechanism 36. Latching switches 130 have normally open contacts 134 in a line 136 between power source 110 and a "latched" light 138. Thus, when the latching mechanisms are moved to a latched condition, switch contacts 134 are closed to give an indication to the operator that the latching mechanisms are in a latched condition. Likewise, an "unlatched" light 140 is also located in the cab for the vehicle and a pair of switches 142 having normally open contacts 144 are respectively located on transverse beams 32 and are actuated or closed by actuating mechanisms 132. Thus, when the latching mechanisms are moved to the unlatched condition, switch contacts 144 are closed to complete the circuit to the "unlatched" light 140 through line 146.

Considering now the portion of the circuit for operating the extend and retract solenoid valve means 78, a manually operated selector means or switch 150 is connected in series with the contacts 144 of switches 142 to main power source 110. Selector means or switch 150 is preferably a three-position switch that has a switch arm 151 which is normally held in a neutral intermediate position illustrated in FIG. 7. Selector switch 150 also has first and second contacts 152 and 154 respectively connected through lines 155 and 156 directly to solenoids 84 and 86.

With the circuit so far described, switch arm 151 may be moved into engagement with either contact 152 or 154 to energize, extend or retract solenoids 84 or 86. However, before such solenoids can be energized, the latching mechanisms must be in an unlatched condition to close contacts 144. This insures that the spreader cannot be extended or retracted inadvertently when a container is attached to the spreader.

According to the primary aspect of the present invention, the electric control circuit also includes holding means for maintaining either of the solenoids energized after initial energization through selector means 150 and the holding means also precludes simultaneous energization or operation of both solenoids 84 and 86. The control circuit also includes position control means for automatically deenergizing either solenoid when the spreader sections have reached a predetermined position with respect to each other.

Holding means 160 illustrated in FIG. 7 consists of first and second relay means 162 and 164 which are interposed between lines 155 and 156 and also a line 166 connected to main power source 110 through position control means or switch 168. Holding relay means 162 includes a holding relay coil 170 that is connected to line 155 through a branch line 171 and is grounded through line 172. Holding relay means also has a switch arm 174 which cooperates with first and second contacts 176 and 177 respectively connected to lines 166 and branch line 171. The connection between contact 177 and branch line 171 preferably incorporates a diode 178 and lines 171 and 172 are likewise interconnected by a diode 179. Second holding relay means 164 likewise includes a holding relay coil 180 connected through branch line 181 to line 156 and also grounded through line 172. Relay 180 cooperates with a second relay switch arm 182 and a pair of contacts 184 and 186 and contact 186 is connected by diode 187 to line 181 while line 181 is connected to ground line 172 by diode 188.

Position control means 168 is in the form of a two-position switch that has an actuator 190 normally biased to an open position by a spring 192.

The operation of the holding means 160 can readily be appreciated from the above description but will briefly be summarized for purposes of clarity. Assuming solenoid 84 is energized by selector switch means 150, such energization will also energize relay coil 170 and, therefore, move relay switch arm 174 into engagement with contact 177. With relay switch arm 174 in engagement with contact 177, solenoid 84 will remain energized by current flow from main line 110 through switch arm 190, which has been moved to its second position, and through line 166, relay arms 182 and 174. Relay coil 170 remains energized through the same circuit until position control means 168 is opened.

The holding means 160 also precludes simultaneous energization of both solenoid 84 and 86. For example, assuming that solenoid 84 is energized through the circuit just described, if for any reason, switch arm 151 is moved to energize contact 154 thereby energizing solenoid 86, relay coil 180 is likewise energized and will move switch arm 182 away from contact 184 and thereby interrupt the circuit to extend solenoid 84.

With the arrangement described above, the operator need only momentarily move switch arm 151 to either the extend or retract position and one solenoid 84 or 86 will automatically be energized. The energized solenoid remains energized through holding means 160 until such time as switch 168 is moved to its inoperative or open position at which time the circuit is interrupted to holding means 160 and the energized solenoid becomes deenergized.

According to another aspect of the invention, the control circuit also incorporates unique means for automatically interrupting the circuit at predetermined positions of the respective extensible sections with respect to the base section. This mechanism is in the form of an actuating member that is capable of positioning the spreader in any number of intermediate positions between the minimum and maximum position for the spreader.

Figure 4:
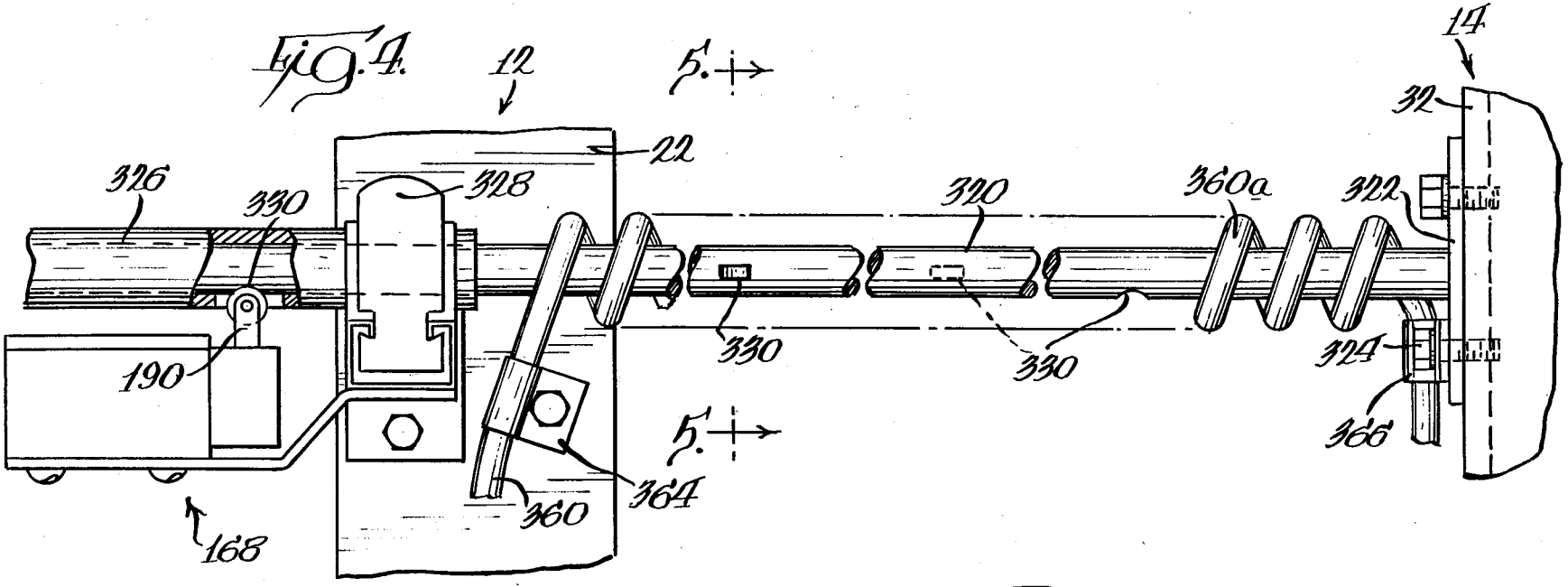
FIG. 4 is an enlarged fragmentary view of the actuating member for the electric control circuit.
Figure 5:
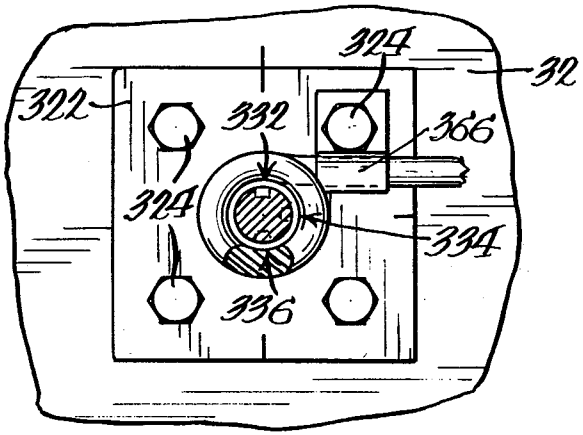
FIG. 5 is a fragmentary view taken along line 5—5 of FIG. 4.

The details for the unique actuating mechanism for position control means 168 is illustrated in FIGS. 4 and 5 and consists of an actuating member or rod 320 that has a plate 322 secured to one end thereof as by welding. Plate 322 is secured by four equally spaced bolts 324 to expansible frame section 14, more particularly to transverse beam 32. The inner end of actuating member or rod 320 is preferably guided on the base section 12 through an elongated tube 326 supported at spaced locations on cross members 22 through brackets 328.

The actuator member or rod 320 has spaced means along the length thereof which accommodate movement of actuator 190 between first and second positions. As illustrated in FIGS. 4 and 5, rod 320 has a plurality of detents 330 and the detents are aligned in a plurality of sets which are circumferentially spaced around the periphery of rod 320. By way of example, a first set of axially aligned detents 332 could include two detents that respectively define the 20 foot and 40 foot position of the extensible sections with respect to the base section and a second set of detents 334 could include three detents respectively defining the 20 foot, 30 foot, and 40 foot positions for the spreader frame while a third set of detents 336 could define positions of 20, 30, 35 and 40 feet for the extensible sections with respect to the base section.

With this arrangement, if a straddle carrier having an expansible spreader of the type disclosed above is to be used in an area where the containers being transported include 20, 30 and 40 foot containers, the tube 320 would be positioned to have the set of detents 334 aligned with actuator 190. With this arrangement, and assuming that the spreader 10 is in a fully retracted position illustrated in FIG. 1, if the operator momentarily moves switch 150 to energize contact 152 and solenoid 84, movement will begin which will move switch actuator 190 of position control means 168 to a second position to energize holding means 160 and retain solenoid 84 energized.

When the extensible sections 14 reach a position where latching mechanisms 34 are spaced from each other by a dimension corresponding to a 30 foot container, position control means 168 is opened to automatically allow valve 78 to move to its centered neutral position. When valve 78 moves to the central neutral position, hydraulic check valves 93 and 94 automatically close to lock the hydraulic fluid in both ends of fluid rams 40. The two synchronizing cables 50 being tensioned in opposite directions between the base section 12 and both extensible sections 14 prevents fluid from being transferred from one cylinder 42 to the other cylinder 42. This will lock the expansible sections 14 in a predetermined position on base section 12 which corresponds to a position in which a 30 foot container can be transported. If it then becomes necessary for the operator to convert spreader 10 to accommodate 40 foot containers, it is only necessary for the operator to momentarily energize contact 151 through switch 150 and extensible sections 14 will automatically move to the 40 foot position and be locked in that position.

If it then becomes desirable or necessary to be capable of maneuvering containers having lengths of 20, 30, 35 and 40 feet at one given site, it is only necessary for the operator to remove four bolts 324, rotate plate 322 90 degrees counterclockwise and reinsert bolts 324. The spreader is then automatically conditioned for automatically moving to the four positions corresponding to the four sizes of containers to be transported at that given site. Of course, any number of combinations of container sizes can readily be incorporated into the spreader by having a plurality of tubes 320 with detents 330 located at different positions along an axial path located in the path of actuator arm 190. Thus, with this arrangement, spreader 10 can readily be adapted to accommodate an infinite number of sizes of containers intermediate the minimum size, such as 20 feet, and the maximum size, such as 40 feet, merely by replacing a single component which can readily be done in a manner of minutes.

Furthermore, utilizing the electric control circuit described above, in conjunction with the self-locking check valves in the hydraulic circuit, along with the synchronizing mechanism 50 eliminates the need for having any type of mechanical interlock between the expansible sections and the base section of the three section spreader. The infinite number of expanded positions for the spreader can readily be accomplished with the same identical electric and hydraulic circuit and only a single switch is necessary for defining the various positions for the spreader. Of course, while the arrangement has been described specifically in connection with a three section spreader, the same principles could equally apply to a two-section expansible spreader.

One of the other problems encountered in designing an acceptable expansible spreader to accommodate containers of different sizes is to simplify the electrical and hydraulic connections between the components that are of necessity located in the cab, on the base section of the spreader, and on the extensible sections thereof. In order to simplify the hydraulic connections, it is desirable to have all of the valves located on a common valve bank which is located on the base section of the spreader. Furthermore, by having the respective valves, such as latch mechanism valve means 76 and extension valve means 78 located in a common bank along with other valves such as side-shift valve means of the type disclosed in application Ser. No. 844,655 and having the valves all connected in series with each other requires only a single pair of conduits leading from the main frame for the straddle carrier to the vertically adjustable spreader. However, problems are still encountered in making the appropriate electrical and hydraulic connections between the various components that of necessity must be located on the transverse beams of the expansible spreader sections. For example, it is essential to have the probe switches as well as the latched and unlatched switches on the expansible sections of the spreader and the fluid ram means 36 for latching and unlatching the respective latching mechanisms must also of necessity be located on the transverse beam in order to provide a reliable unit that can be manufactured at a nominal cost.

According to a further aspect of the present invention, the electrical cable interconnecting the various electrical components on the base section and the expansible section is supported in a unique fashion to accommodate extension of the respective extensible sections 14 on base section 12 without any possibility of the cable becoming entangled with any fixed components.

As most clearly illustrated in FIG. 4, an electrical cable 360 has a coiled intermediate section **360*a* which forms a helix around circular rod or tube 320 and the opposite ends of the coiled portion 360*a* of cable means 360 are respectively secured by brackets 364 and 366 to base section 12 and extensible section 14. Thus, during the extension of expansible member 14 on base section 14 the pitch of the helix of coiled portion 360*a* increases and when the spreader sections are retracted, the pitch of the helix decreases. With this arrangement, no additional components need be added to the spreader to accommodate the increase and decrease in effective length of cable 360. Heretofore, many complicated mechanisms were required to accommodate this extension and retraction. A second rod 320 supporting cable 360 and supported by tube 326 may lead to the opposite end of spreader 10 and rod 320 need not have the detents 330 thereon. If necessary, two such rods and tubes could extend to the extensible section ifadditional cables were required. Of course, cable 360 would have a sufficient number of wires therein to be connected to the various probe switches, latching and unlatching switches and other electrical components that of necessity must be located on the transverse beams 32 of spreader 10**.

The hydraulic connection between control valves 76 and fluid rams 36 likewise must have conduits which expand and contract to accommodate expansion of the spreader. In the illustrated embodiment, this is accomplished by directing conduits 105 and 106 to a pair of coiling drums 370 and 372 located adjacent opposite ends of base section 12 and then from coiling drums 370 and 372 to the respective ends of fluid rams 36.

From the above description it will be appreciated that the present invention provides an extremely simple hydraulic and electric circuit for accurately positioning an expandable spreader into any number of a plurality of positions intermediate minimum positions to accommodate containers of various sizes. Furthermore, the spreader can readily be converted to accommodate containers of different predetermined sizes by manipulation or replacement of a single inexpensive component, which can be performed in a matter of minutes.

It should also be noted that the locking of the expansible sections 14 on base section 12 could also be accomplished by having a pair of pressure responsive check valves or lock valves adjacent opposite ends of each cylinder 42 in which case cables 50 would not have to be relied upon for preventing transfer of fluid between the cylinders.

What is claimed is:

1. In an extensible spreader having a base section and an extensible section telescoped on said base section with hydraulic ram means for extending and retracting said extensible section; a hydraulic circuit including a reservoir, a pressurized hydraulic source, conduit means connecting said reservoir and source to said ram means and solenoid operated valve means in said conduit means; and an electric control circuit for controlling said valve means, said control circuit including a power source, extend and retract solenoids for said valve means, manually operated selector means for selectively energizing one of said solenoids, holding means for maintaining said one of said solenoids energized when said manually operated selector means is returned to a neutral position and for precluding simultaneous energization of both solenoids, and position control means for deenergizing said one of said solenoids when said extensible section reaches a predetermined position with respect to said base section.

2. An extensible spreader as defined in claim 1, in which said holding means effects deenergization of said one of said solenoids when the other of said solenoids is energized by said manually operated selector means.

3. An extensible spreader as defined in claim 2, in which said holding means includes first and second holding relay means respectively interposed in series between said power source, said position control means and said solenoids.

4. An extensible spreader as defined in claim 3, in which said extensible section has latching mechanisms movable between latched and unlatched positions with switch means in series with said power source and said manually operated selector means to prevent energization of either of said solenoids when said latching mechanisms are other than in said unlatched position.

5. An extensible spreader as defined in claim 1, in which said hydraulic circuit includes lock means for locking said fluid rams when said solenoids are deenergized.

6. An extensible spreader as defined in claim 1, in which said position control means includes a single two-position switch having an actuator normally biased to an open position and said extensible section having an actuating member for moving said two-position switch between said positions.

7. An extensible spreader as defined in claim 6, in which said actuating member is an elongated rod having one end guided on said base section and an opposite end secured to said extensible section with said actuator biased into engagement with the periphery of said rod, and in which the periphery of said rod has spaced detents defining a plurality of predetermined positions for said extensible section on said base section.

8. An extensible spreader as defined in claim 7, in which said rod is circular and has a plurality of sets of axially aligned circumferentially spaced detents so that different predetermined positions can be selected by aligning different sets of detents with said actuator.

9. An extensible spreader as defined in claim 6, in which said actuating member is a circular rod and said electric control circuit has switches on the free end of said extensible section with electric cable means extending from said switches to said base section, said cable means being coiled around said rod and said coiled cable means expanding and contracting to accommodate extension and retraction of said extensible section.

10. An extensible spreader as defined in claim 6, further including a second extensible section movable on said base section with synchronizing means between said sections to produce equal increments of movement of both extensible sections relative to said base section.

11. A control circuit for expanding and contracting at least two spreader sections relative to each other by a fluid ram interposed between said sections consisting of a hydraulic circuit including a reservoir, a pressurized fluid source with conduit means between said reservoir, fluid source and fluid ram, and solenoid operated valve means having extend and retract solenoids; and an electric control circuit including a power source, manually operated selector means connected to said power source and said solenoids for selectively energizing said solenoids, and position control means for deenergizing an energized solenoid, said position control means including a single switch means supported on one of said sections and having an actuator movable between operative and inoperative positions, and elongated actuating member supported on the other of said sections and cooperating with said switch means to allow said switch means to be moved from said operative position to said inoperative position when said sections are in a predetermined position with respect to each other.

12. A control circuit as defined in claim 11, in which said electric control circuit includes electric components on both sections interconnected by at least one electric cable and in which said electric cable has an intermediate portion helically coiled around said actuating member to accommodate extension and retraction of said sections.

13. A control circuit as defined in claim 12, in which said actuating member is a circular rod having a plurality of detents defining a plurality of predetermined positions and said one of said sections has a guide tube supporting a free end of said rod.

14. A control circuit as defined in claim 13, in which said rod has a plurality of sets of axially spaced detents circumferentially spaced from each other so that a selected set of detents can be aligned with said switch means to vary the predetermined positions for said spreader sections.

15. A control circuit as defined in claim 11, in which said hydraulic circuit includes hydraulic lock means for locking said fluid ram and spreader sections when both said solenoids are deenergized.

16. A control circuit as defined in claim 15, in which said manually operated selector means includes extend, neutral and retract positions and said electric control circuit includes holding means for maintaining the selected solenoid energized after said manually operated selector means is returned to a neutral position.

17. A control circuit as defined in claim 16, in which said holding means also precludes simultaneous energization of both solenoids.

18. A control circuit as defined in claim 17, in which said single switch means and said holding means are arranged in series between said power source and said solenoids and in which said holding means includes first and second contact means each movable between a normal position and an actuated position, said contact means holding the circuit to the energized solenoid when one contact means is in the normal position and the contact means is in the operative position and said contact means interrupting the circuit to both solenoids when both contact means are in a normal position.

19. A control circuit as defined in claim 18, in which said holding means includes first and second relay coils selectively energized when said manually operated selector means is moved to the extend or retract positions, said relay coils being operative to respectively move said first and second contact means from said normal position to said operative position.

* * * * *